US010137318B2

(12) United States Patent
Fromage

(10) Patent No.: US 10,137,318 B2
(45) Date of Patent: Nov. 27, 2018

(54) AIRCRAFT DEMAND REGULATOR AND DILUTION REGULATION METHOD

(75) Inventor: Matthieu Fromage, Saint-arnoult-en-yvelines (FR)

(73) Assignee: Zodiac Aerotechnics, Plaisir (FR)

( * ) Notice: Subject to any disclaimer, the term of this patent is extended or adjusted under 35 U.S.C. 154(b) by 965 days.

(21) Appl. No.: 13/981,644

(22) PCT Filed: Feb. 21, 2011

(86) PCT No.: PCT/IB2011/000772

§ 371 (c)(1),
(2), (4) Date: Jul. 25, 2013

(87) PCT Pub. No.: WO2012/114145

PCT Pub. Date: Aug. 30, 2012

(65) Prior Publication Data

US 2013/0306073 A1 Nov. 21, 2013

(51) Int. Cl.

| | |
|---|---|
| ***A62B 7/00*** | (2006.01) |
| ***A62B 9/00*** | (2006.01) |
| ***A62B 9/02*** | (2006.01) |
| ***A62B 7/14*** | (2006.01) |

(52) U.S. Cl.

CPC ..... *A62B 9/027* (2013.01); *A62B 7/00* (2013.01); *A62B 7/14* (2013.01); *A62B 9/022* (2013.01)

(58) Field of Classification Search

CPC .. A62B 7/00; A62B 7/14; A62B 9/022; A62B 9/027

See application file for complete search history.

(56) References Cited

U.S. PATENT DOCUMENTS

| | | | |
|---|---|---|---|
| 3,608,574 | A | 9/1971 | Beaussant |
| 4,336,590 | A | 6/1982 | Jacq et al. |
| 6,789,539 | B2 | 9/2004 | Martinez |
| 6,796,306 | B2 | 9/2004 | Martinez |
| 6,994,086 | B1 | 2/2006 | Martinez et al. |

(Continued)

FOREIGN PATENT DOCUMENTS

| | | |
|---|---|---|
| EP | 1579890 A1 | 9/2005 |
| FR | 1427955 | 1/1966 |

(Continued)

OTHER PUBLICATIONS

International Search Report and Written Opinion dated Jan. 11, 2012 in Application No. PCT/IB2011/000772.

*Primary Examiner* — Bradley Philips
(74) *Attorney, Agent, or Firm* — Kilpatrick Townsend & Stockton LLP; Dean W. Russell

(57) ABSTRACT

A demand regulator (1) for aircraft breathing device (100) comprising: —a respiratory chamber (9) supplied with respiratory gas comprising breathable gas and dilution gas, —a breathable gas supply line (12, 13), —a dilution gas supply line (14, 15), —a first adjusting device (50, 60) of non-electrical type adjusting the pressure in the respiratory chamber (9), and —a second adjusting device (22, 24, 40, 41-49) adjusting the rate of dilution gas in the respiratory gas supplied to the respiratory chamber (9), the second adjusting device comprising a dilution valve (24) disposed in the dilution gas supply line (14, 15), a sensor (41-49) and an electrical control unit (40) adjusting the rate of dilution gas in the respiratory gas by controlling the dilution valve (24).

21 Claims, 2 Drawing Sheets

(56) References Cited

U.S. PATENT DOCUMENTS

| | | | | |
|---|---|---|---|---|
| 2003/0084901 | A1* | 5/2003 | Martinez | A62B 7/14<br>128/204.26 |
| 2007/0107729 | A1 | 5/2007 | Aubonnet et al. | |
| 2009/0277449 | A1 | 11/2009 | Bloch et al. | |
| 2010/0024821 | A1* | 2/2010 | Rittner | B64D 10/00<br>128/204.29 |

FOREIGN PATENT DOCUMENTS

| | | | |
|---|---|---|---|
| FR | 1484691 | | 5/1967 |
| GB | 1092309 | | 11/1967 |
| GB | 1175604 | | 12/1969 |
| WO | 2008010021 | A1 | 1/2008 |
| WO | 2009007794 | A1 | 1/2009 |

* cited by examiner

AIRCRAFT DEMAND REGULATOR AND DILUTION REGULATION METHOD

CROSS REFERENCE TO RELATED APPLICATIONS

This application is the U.S. national phase of International Application No. PCT/IB2011/000772 filed on Feb. 21, 2011, and published in English by the World Intellectual Property Organization on Aug. 30, 2012 as International Publication No. WO 2012/114145 A1, the contents of which are incorporated herein by reference.

FIELD OF THE INVENTION

The present invention relates to an aircraft demand regulator and a dilution regulation method for protecting the occupant (passengers and/or crewmembers) of an aircraft against the risks associated with high altitude depressurization and/or smoke and fume in the cabin.

In particular, the invention relates to the adjustment of the respiratory gas supplied to a user to satisfy the needs of the user, using a source of breathable gas supplying pure oxygen (oxygen cylinder, chemical generator or liquid oxygen converter) or gas highly enriched in oxygen such as an on-board oxygen generator system (OBOGS).

To ensure the protection of the passengers and/or crewmembers in case of depressurization and/or occurrence of smoke in the aircraft, the demand regulators shall deliver a respiratory gas which is a mixture of dilution gas (generally ambient air) and breathable gas depending of cabin altitude. After a depressurization, the cabin altitude reaches a value close to the aircraft altitude. The pressure value of the cabin is often referred to as the cabin altitude. Cabin altitude is defined as the altitude corresponding to the pressurized atmosphere maintained within the cabin. This value differs from the aircraft altitude which is its actual physical altitude. Correspondence between pressure and conventional altitude are defined in tables. The minimum rate of oxygen in the respiratory gas according to the cabin altitude is set for civil aviation by the Federal Aviation Regulations (FAR).

Breathing mask for crewmember generally includes a demand regulator and an oronasal face piece. Demand regulators start supplying respiratory gas in response to the user of the breathing mask breathing in and stop supplying respiratory gas when the user stops breathing in.

BACKGROUND OF THE INVENTION

Most of the current crew breathing masks are equipped with oxygen regulators using pneumatic technology to satisfy this requirement. In this technology, ambient air is sucked through a dilution gas supply line by a Venturi which provides suction by high velocity flow of breathable gas. An aneroid capsule (called also altimeter capsule) regulates the altimetric oxygen enrichment by adjusting the section of the dilution gas supply line. Such demand regulators are known from the documents U.S. Pat. No. 6,994,086, FR 1 484 691 or U.S. Pat. No. 6,796,306. As the oxygen enrichment depends on the section of the dilution gas supply line controlled by the aneroid capsule clearance, the oxygen consumption cannot be optimal for all of the cabin altitude range and/or for all of the breathing ventilation.

The need to save oxygen has lead to the development of electropneumatic regulator as described in the documents U.S. Pat. No. 4,336,590, U.S. Pat. No. 6,789,539, US 2007/0107729 or US2009/0277449. The demand regulators disclosed in these documents comprise an electrical valve controlled by an electronic circuit for adjusting the rate of oxygen in the respiratory gas. These demand regulators electrically control both the pressure of the respiratory gas relative to the cabin pressure and the oxygen rate of the respiratory gas. Reliability of these demand regulators is linked to the reliability of the electronic circuit or the electrical power supply. For example, in case of electrical power supply breakdown, these demand regulators do not protect the user against hypoxia or fire smoke.

Some improvements have been made in the past by adding a pneumatic demand regulator to the electro-mechanical regulator, the pneumatic demand regulator providing a backup solution which is used only in case of electrical failure. But this leads to systems far more complex and bulky than the classical regulator with Venturi and aneroid capsule for dilution control.

So, it is already known, for example from a first embodiment disclosed in document U.S. Pat. No. 6,789,539, a demand regulator for aircraft breathing device comprising:

- a respiratory chamber supplied with respiratory gas comprising breathable gas and dilution gas,
- a breathable gas supply line to be connected to a source of breathable gas and supplying the respiratory chamber with breathable gas,
- a dilution gas supply line to be connected to a source of dilution gas and supplying the respiratory chamber with dilution gas,
- a first adjusting device adjusting the pressure in the respiratory chamber, and
- a second adjusting device adjusting the rate of dilution gas in the respiratory gas supplied to the respiratory chamber, the second adjusting device comprising a dilution valve disposed in the dilution gas supply line and the dilution valve being movable between a retracted position and a protruded position.

This demand regulator appears satisfying in normal condition, but does not protect the user in case of electrical failure. The aim of the invention is to improve the reliability of this demand regulator.

Document U.S. Pat. No. 6,789,539 further discloses a second embodiment of demand regulator, wherein the first adjusting device is of non-electrical type, the demand regulator further comprises a third adjusting device controlling the flow rate of breathable gas in the upstream portion of the breathable gas supply line and the second adjusting device comprises an altimeter capsule. Such a demand regulator could be quite satisfying in case of electrical failure. But, it is complicated and above all it is very difficult to settle in normal conditions because the supply of breathable gas is controlled by both first adjusting device and second adjusting device.

SUMMARY OF THE INVENTION

The purpose of this invention is to provide a demand regulator which is reliable, quite cheap, simple to settle and supplies an oxygen rate in compliance with the minimum required while being close to the minimum required.

For this purpose, according to the invention, the first adjusting device is of non-electrical type, and the second adjusting device comprises a sensor and an electrical (electronic) control unit, the electrical control unit receiving a signal from the sensor and the electrical control unit adjusting the rate of dilution gas in the respiratory gas by controlling the dilution valve in function of said signal.

Therefore, the settlement of the first adjusting device is easier to achieve, the rate of oxygen in the respiratory gas can be accurately adjusted by the second adjusting device in normal condition (without electrical failure) and the adjustment of the pressure in the respiratory chamber is quite satisfying thanks to the first adjusting device in normal condition and in case of electrical failure.

According to another feature in accordance with the invention, preferably the aircraft breathing device further comprises a safety device for automatically increasing the concentration of breathable gas in case of failure of the second adjusting device.

Thus, in case of electrical failure, the rate of oxygen in the respiratory gas supplied to the user cannot be accurately adjusted, but it complies with the minimum requirements.

According to another feature in accordance with the invention, preferably the demand regulator has a casing including a respiratory gas supply line shared by the downstream portion of the breathable gas supply line and the downstream portion of the dilution gas supply line.

Therefore, the effect of friction loss in the dilution gas supply line is reduced which enables to supply respiratory gas with a lower rate of breathable gas when the user deeply breathes in at low cabin altitude while non electrically controlling the main valve.

According to another feature in accordance with the invention, preferably the whole dilution gas supply line has a section greater than 100 square millimeters when the dilution valve is in the retracted position.

This feature also enables to supply respiratory gas with a lower rate of breathable gas (ideally null whatever the breathing of the user is).

According a supplementary feature in accordance with the invention, preferably the breathable gas supply line is deprived of Venturi and ejector ejecting breathable gas into the respiratory chamber.

Indeed, it appears that Venturi and ejector would tend to generate a movement of the main valve towards the open position and therefore complicate the regulation of the rate of breathable at low levels.

Other features of the invention are subject of dependent claims.

The invention also relates to a method for regulating dilution of the breathable gas supplied to the user. In accordance with the invention, the dilution regulation method comprises:

- supplying a respiratory chamber with respiratory gas comprising breathable gas and dilution gas, the breathable gas including high rate oxygen,
- electrically adjusting the rate of dilution gas in the respiratory gas supplied to the respiratory chamber, and
- non electrically regulating the pressure in the respiratory chamber.

BRIEF DESCRIPTION OF THE DRAWINGS

Other features and advantages of the present invention will appear in the following detailed description, with reference to the appended drawings in which.

DETAILED DESCRIPTION OF THE INVENTION

Figure 1:
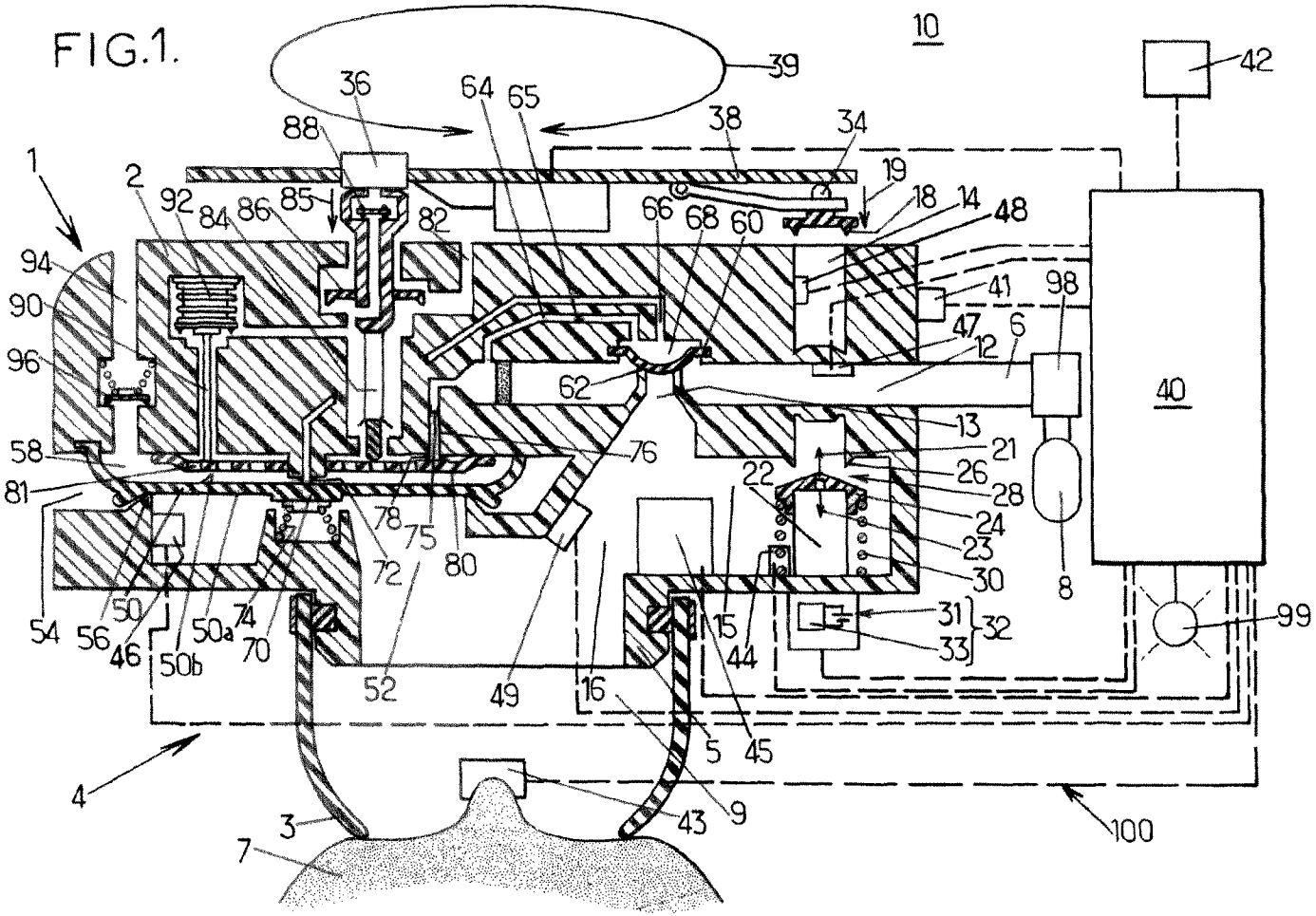
FIG. 1 diagrammatically shows a first embodiment of aircraft breathing device according to the invention, FIG. 2 partially shows a second embodiment of aircraft breathing device according to the invention

FIG. 1 shows an aircraft breathing device 100 mainly comprising a pressurized source of breathable gas 8, a feeding duct 6, a breathing mask disposed in a cabin 10 of an aircraft. In the embodiment shown, the pressurized source of breathable gas 8 is a cylinder containing pressurized oxygen.

The breathing mask 4 comprises a demand regulator 1 and an oronasal face piece 3 fixed to a tubular connecting portion 5 of the regulator 1. When a user 7 dons the breathing mask 4, the oronasal face piece 3 is put to the skin of the user face 7 and delimits a respiratory chamber 9 in which the user 7 breathes in and breathes out.

The demand regulator 1 has a casing 2 including an inhalation circuit and an exhalation circuit.

The inhalation circuit includes a breathable gas supply line 12, 13 and a dilution gas supply line 14, 15. The breathable gas supply line comprises an upstream portion 12 supplied with pressurized oxygen by the source of breathable gas 8 through the feeding duct 6 and a downstream portion 13 supplying the respiratory chamber 9 with breathable gas. The dilution gas supply line comprises an upstream portion 14 in communication with a source of dilution gas and a downstream portion 15 supplying the respiratory chamber 9 with dilution gas. In the illustrated embodiment, the dilution gas is air and the source of dilution gas is the cabin 10 of the aircraft. An end portion of the downstream portion of the breathable gas supply line 13 and an end portion of downstream portion of the dilution air supply line 15 are merged into a respiratory gas supply line 16 in which flows a respiratory gas including breathable gas and dilution gas mixed. So, in the embodiment illustrated, the breathable gas and the dilution gas are mixed in the respiratory gas supply line 16 of the casing 2, i.e. before supplying the respiratory chamber 9 through the tubular connecting portion 5.

The aircraft breathing device 100 is deprived of any electrical device causing variation of the pressure in the breathable gas supply line in order to regulate the flow of breathable gas or the like. So, in use the upstream portion 12 of the breathable gas supply line is continuously supplied with breathable gas and preferably at a substantially constant pressure, more preferably regulated by a non electrical (pneumatic) pressure regulator 98 interposed between the source of breathable gas 8 and the breathable gas supply line. Of course, as commonly known, the pressure regulator 98 could be omitted in particular in case the source of breathable gas 8 is an OBOGS or the like. As known from WO2009/007794, a valve could isolate the upstream portion 12 of the breathable gas supply line from the source of breathable gas 8 when the breathing mask 4 is not donned by the user, but stored in a storage box.

The exhalation circuit comprises a pilot valve 50 and an exhaust line which comprises an upstream portion 52 and a downstream portion 54. The upstream portion 52 of the exhaust line is in communication with the respiratory chamber 9 of the oronasal face piece 3 through the tubular connecting portion 5 and receives gas exhaled by the user. The tubular connecting portion 5 of the regulator 1 is deprived of separation between the respiratory gas supply line 16 and the upstream portion 52 of the exhaust line. The downstream portion 54 of the exhaust line is in communication with ambient air of the cabin 10. The pilot valve 50 is a flexible airtight membrane which separates a pilot chamber 58 from the upstream portion 52 of the exhaust line and the downstream portion 54 of the exhaust line both disposed on the other side of the membrane 50. So, the pilot valve 50 has a first surface 50*a* subjected to the pressure in the upstream portion 52 of the exhaust line which is similar to the pressure in the respiratory chamber 9 and a second surface 50*b* subjected to the pressure in the pilot chamber 58.

The casing 2 of the regulator 1 further comprises a first conduit 64, a second conduit 66 and a main valve 60 cooperating with a fixed seat 62. The main valve 60 is formed by a membrane movable between a closed position and an open position. In the closed position, the main valve 60 rests on the fixed seat 62 and interrupts communication between the upstream portion 12 and the downstream portion 13 of the breathable gas supply line. In the open position the main valve 60 is away from the fixed seat 62 and the upstream portion 12 is in communication with the downstream portion 13 of the breathable gas supply line.

Whatever the position of the main valve 60 is, the membrane of the main valve 60 separates a control chamber 68 disposed on one side of the membrane from the breathable gas supply line, both upstream portion 12 and the downstream portion 13 of the breathable gas supply line being disposed on the other side of the main valve 60. The control chamber 68 communicates with the upstream portion 12 of the breathable gas supply line through the first conduit 64 which comprises a calibrated constriction 65.

The casing 2 of the regulator 1 further comprises a first seat 56, a second seat 72 and an obturator 70 carried by the membrane of the pilot valve 50. The obturator 70 cooperates with the second seat 72. The obturator 70 is biased towards the second seat 72 by a spring 74. When the pressure in the upstream portion 52 of the exhaust line is equal to the pressure in the pilot chamber 58, the pilot valve 50 is in a rest position. In the rest position, due to the biasing pressure of the spring 74, the obturator 70 rests on the second seat 72 and closes the second conduit 66, since the second conduit 66 ends in the second seat 72. Thus, the control chamber 68 is isolated from the pilot chamber 58. Otherwise, in the rest position the pilot valve 50 rests on the first seat 56 and therefore separates the upstream portion 52 of the exhaust line from the downstream portion 54 of the exhaust line.

The regulator 1 further comprises an electrical adjusting device for adjusting the rate of oxygen in the respiratory gas supplied to the respiratory chamber 9. The electrical adjusting device mainly comprises a dilution valve 24, an actuator 22, an electrical control unit 40 and sensors 41-49.

The dilution valve 24 is movable from a retracted position to a protruding position as shown by arrow 21 and from the protruding position to the retracted position as shown by arrow 23. The electrical control unit 40 controls the actuator 22 which drives the dilution valve 24. The actuator 22 is preferably proportional, but it would be possible to use an on/off actuator controlled using pulse width modulation or duty cycle techniques. The dilution valve 22 is shown in an intermediate position between the retracted position and the protruding position.

A passage 28 is provided between a dilution seat 26 and the dilution valve 24. The movement of the dilution valve 24 causes the section of passage 28 to be modified. Preferably, in the protruding position the dilution valve 24 rests on the dilution seat 26 and isolates the upstream portion 14 of the dilution gas supply line from the downstream portion 15 of the dilution gas supply line. Advantageously, in the retracted position of the dilution valve, the section of the passage 28 is higher than 100 square millimeters, and more preferably the cross section of the whole dilution gas supply line is higher than 100 square millimeters.

The regulator 1 advantageously further has at least one regulation sensor amongst a cabin pressure sensor 41 detecting the absolute pressure in the cabin 10, an aircraft pressure sensor 42 detecting the absolute pressure outside the aircraft corresponding to the aircraft altitude, a saturation sensor 43 carried by the oronasal face piece 3 and detecting the saturation in oxygen of the user blood, a position sensor 44 detecting the position of the dilution valve 22, a gas sensor 45 placed in the respiratory gas supply line 16 and detecting the rate of oxygen in the respiratory gas, a respiratory pressure sensor 46, a breathable gas flow meter 47 placed in the breathable gas supply line 12, 13 sensing the flow of the breathable gas, a dilution gas flow meter 48 placed in the dilution gas supply line 14, 15 sensing the flow of the dilution gas or a respiratory gas flow meter 49 placed in the respiratory gas supply line 16 and detecting the flow of respiratory gas.

The regulation sensors 41-49 transmit a signal (an electrical signal in the embodiment illustrated, but it could be an electromagnetic signal in a variant) to the electrical control unit 40. The electrical control unit 40 adjusts the position of the dilution in function of the information (signal) provided by the regulation sensors.

It should be noticed that the gas sensor 45 preferably detects the partial pressure in oxygen in the respiratory gas. In a variant, the gas sensor 45 may detect the concentration (proportion) in oxygen in the respiratory gas.

The gas sensor 45 is preferably an electrochemical sensor, a galvanic oxygen sensor, a paramagnetic oxygen sensor, a solid electrolyte gas sensor, optical sensor, ultrasonic gas sensor or fluorescence oxygen sensor (optode). The solid electrolyte gas sensor may be for example a Zirconium gas sensor or a titania gas sensor. In particular, the optical sensor may be an infrared sensor, it may include a tunable diode laser, and it may detect absorption, reflection or transmission, or a combination of absorption, reflection and transmission. The ultrasonic gas sensor preferably uses the measure of the sound speed and the gas temperature for computing the mixture composition. The fluorescence oxygen sensor preferably has a LED excitation source, a fluorescence detector and a fluorescent substrate sensitive to oxygen partial pressure.

The respiratory pressure sensor 46 detects the pressure in the respiratory chamber 9. In the embodiment shown in FIG. 1, the respiratory pressure sensor 46 is placed in the upstream portion of the exhalation line 52, but in variant it may be placed directly in the respiratory chamber or in the respiratory gas supply line 16. The respiratory pressure sensor 46 is useful in particular in combination with the gas sensor 45. The respiratory pressure sensor 46 is optional since generally the gas sensor 45 may be used without the respiratory pressure sensor 46. But, in some embodiments the respiratory pressure sensor 46 enables to simplify the regulation of the rate of dilution gas in the respiratory gas and therefore the settlement of the demand regulator, in combination with the gas sensor 45.

The regulator 1 has a regulation (normal) mode, a pure breathable gas mode and an emergency mode which can be selectively activated by the user thanks to a rotating mode selector knob 38 as illustrated by the circular arrow 39.

Without inhalation of the user in the oronasal face piece 3, the control chamber 68 is subjected to the pressure of the breathable gas in the upstream portion 12 of the breathable gas supply line. So, the main valve 60 is pressed against the seat 62, closes the passage between the main valve 60 and the seat 62, and isolates the upstream portion 12 from the downstream portion 13 of the breathable gas supply line.

When the user breathes in, the pressure in the upstream portion 52 of the exhaust line is lower than the pressure in the pilot chamber 58. If the pressure difference is higher than a set inhalation depression necessary to compress the spring 74, the pilot valve 50 is moved (deformed) into an admission position in which the obturator 70 is moved away from the second seat 72 against the biasing pressure of the spring 74. Therefore, the control chamber 68 communicates with the pilot chamber 58 through the second conduit 66 which ends in the control chamber 68. So, the pressure in the control chamber 68 is reduced, the main valve 60 is moved away from the fixed seat 62 and the breathable gas flows through the passage between the main valve 60 and the fixed seat 62. At the end of the inspiration, the pilot valve comes back to the rest position, the obturator 70 rests on the second seat 72 and closes the second conduit 66. Therefore the pressure in the control chamber 68 increases and the main valve 60 becomes pressed against the fixed seat 62 closing the flow of breathable gas.

The set inhalation depression is adapted and the dilution gas supply line is adapted to provide a friction loss sufficiently low so that when the regulation mode of the regulator is selected and the dilution valve 22 is in the retracted position, the pilot valve 50 is maintained in the rest position even when the user inhales in order to provide only dilution gas to the user at low cabin altitude (below 10 kft) in normal condition (without electrical failure). Therefore, the regulator 1 may regulate the concentration of breathable gas in the respiratory gas in the range of 0% to 100%.

When the user exhales, the pressure in the upstream portion 52 of the exhaust line is increased and thus the pilot valve 50 is moved in an exhaust position away from the first seat 62. Therefore, the exhalation gas is exhausted by the downstream portion 54 of the exhaust line.

The mode selector knob 38 has a first cam 34 and a second cam 36.

When the user selects the pure breathable gas mode of the regulator 1 with the rotating mode selector knob 38, as illustrated by the arrow 19, the cam 34 moves a first closing valve 18 into a closing position in which the closing valve 18 closes the inlet of the dilution gas supply line 14, 15, thereby preventing admission of dilution gas into the dilution gas supply line 14, 15. So, the regulator 1 delivers undiluted breathable gas to the user 7 through the respiratory chamber 9.

The regulator 1 further comprises a third conduit 76 with a constriction 75, a third seat 78, an emergency mode valve 80 provided with through holes 81, a first exit conduit 82, a first rod 84, a second closing valve 86, a first relief valve 88, a second rod 90, an altimetric capsule 92, a second exit conduit 94 and a second relief valve 96.

The third conduit 76 extends between the upstream portion 12 of the breathable gas supply line and the pilot chamber 58. In normal mode and pure breathable gas mode, the emergency mode valve 80 rests against the third seat 78 and closes the third conduit 76. At low cabin altitude the pilot chamber 58 is in communication with ambient air of the cabin 10 through the first exit conduit 82. At high cabin altitude (above 40 kft), aviation regulation and standard require to supply the user with positive pressure breathing of undiluted breathable gas. This function is performed by the altimetric capsule 92 and the second rod 90 which moves the emergency mode valve 80, so that at high cabin altitude the emergency mode valve 80 is away from the third seat 78. The pilot chamber 58 is therefore supplied with pressurized breathable gas through the third conduit 76 with restriction 75. Furthermore, the first rod 84 supporting the second closing valve 86 is biased so that when the emergency mode valve 80 is away from the third seat 78 the second closing valve 86 moves (as shown by arrow 85) and closes the first exit conduit 82. The pressure in the pilot chamber 58 is limited by the second relief valve 96 in the second exit conduit 94 which ensures that the overpressure in the pilot chamber 58 does not exceed a predetermined value. The pilot valve 50 controls the main valve 60 for adjusting the pressure in the respiratory chamber to the pressure in the pilot chamber 58.

In case of smoke or fire in the cabin, the user 7, usually crewmember, shall engage the emergency mode by rotating the mode selector knob 38. When the mode selector knob 38 is positioned in the emergency mode, the first cam 34 moves the first closing valve 18 into the closing position preventing admission of dilution gas into the dilution gas supply line 14, 15. Furthermore, the second cam 36 moves the first rod 84, so that the second closing valve 86 closes the first exit conduit 82 and the emergency mode valve 80 is moved away from the third seat 78. The pilot chamber 58 is therefore supplied with pressurized breathable gas through the third conduit 76 with restriction 75. The pressure in the pilot chamber 58 is controlled through the first relief valve 88. The pilot valve 50 controls the main valve 60 for adjusting the pressure in the respiratory chamber to the pressure in the pilot chamber 58.

The regulator 1 shown in FIG. 1 further comprises a mechanical safety device comprising a return spring 30 and an electrical safety device 32 defining two alternative safety devices. The actuator 4 being linear, in case of electrical failure, the return spring 30 moves the dilution valve 22 to the protruding position. The electrical safety device 32 comprises a backup electrical system 33 supplied by a battery 31 and disposed between the actuator 4 and the electrical control unit 40. The backup electrical system 33 is adapted to detect failure of the electrical control unit 40 and to control the actuator 22 to move the dilution valve 22 to the protruding position.

The regulator 1 further includes a warning device 99 which informs the user of an electrical failure, or more generally a failure of the electrical adjusting device 22, 24, 40, 41-49. The warning device 99 provides a light warning, a sound warning, a message warning or the like. Consequently, the user 9 can manually select the pure breathable gas mode or the emergency mode if he is afraid that the safety device is not working or by caution.

In case the regulator 1 is deprived of such safety devices, the user 9 has to manually select the pure breathable gas mode or the emergency mode in case of electrical failure.

It should be noticed that due to the fact the respiratory gas supply line 16 has a large section and that moreover the tubular connecting portion 5 of the regulator 1 is deprived of separation between the respiratory gas supply line 16 and the upstream portion 52 of the exhaust line, the regulator 1 is preferably deprived of Venturi and ejector, in particular it is deprived of Venturi and ejector ejecting breathable gas into the respiratory chamber.

The actuator 22 could be for example of electromagnetic, piezoelectric, electrostatic, pneumatic type or the like.

Moreover, the actuator 22 represented is a linear actuator, but in a variant a rotary actuator could be used.

The dilution valve 62 shown in FIG. 1 is of conical type. But, spherical flapper, shear valve, flat valve would also be convenient. Moreover the dilution seat 26 could be angled relative to the axis of the dilution gas supply line.

The electrical control unit 40 can directly regulate the rate in oxygen in the respiratory gas or by regulating the rate of breathable gas in the respiratory gas. In particular, the electrical control unit 40 can directly regulate the rate in oxygen in the respiratory gas provided to the user directly thanks to the gas sensor 45, or indirectly using information provided by the cabin pressure sensor 41 and preferably at least one of the aircraft altitude sensor 42, the position sensor 44, the dilution gas flow meter 47, the breathable gas flow meter 48 or the respiratory gas flow meter 49.

Otherwise, the electrical control unit 40 can regulate the concentration in oxygen in the respiratory gas provided to the user using an open loop control or closed loop control. In particular, the electrical control unit 40 can regulate the concentration in oxygen in the respiratory gas using an open loop control when using information from the cabin pressure sensor 41 and the saturation sensor 43.

Figure 2:
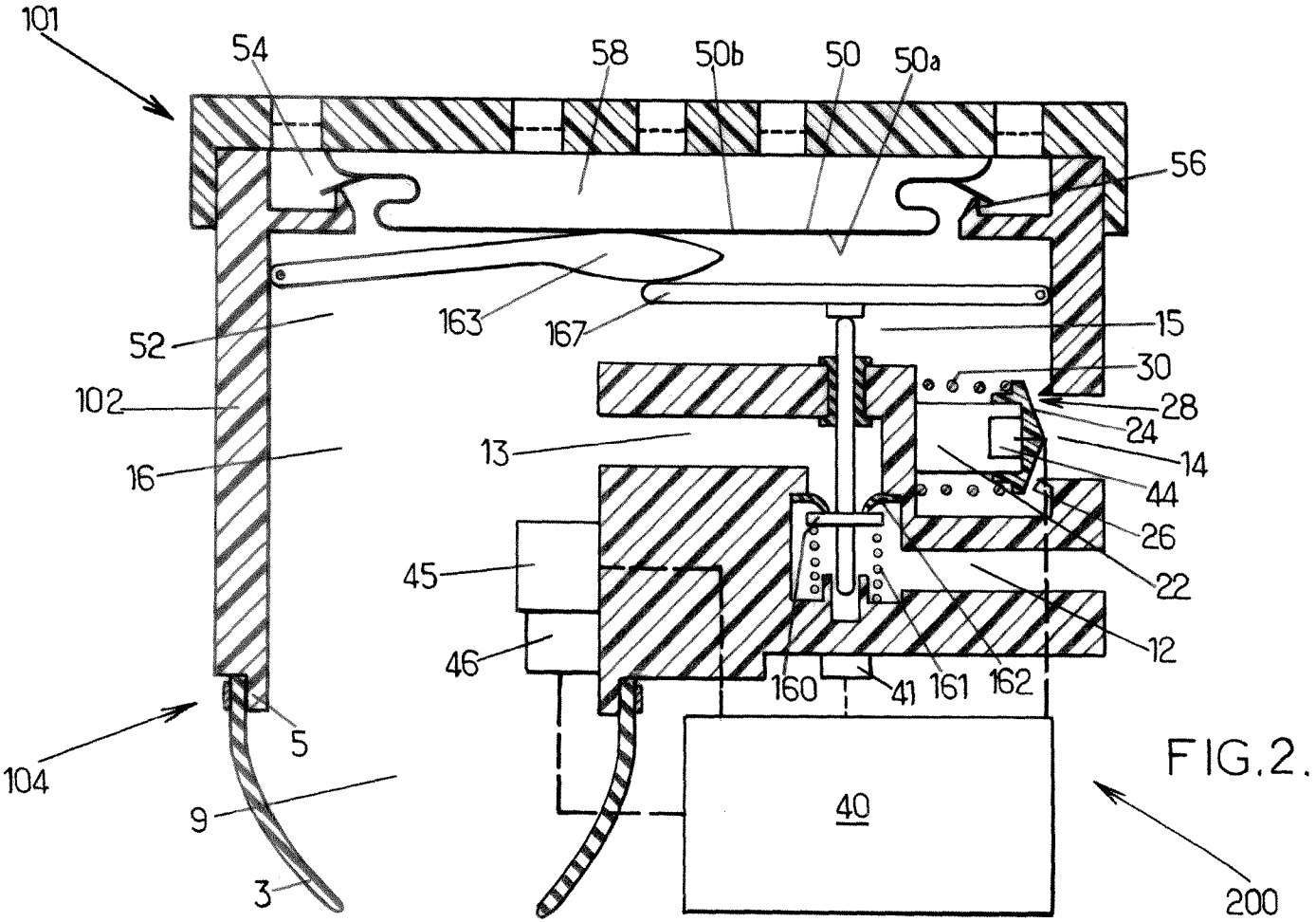

FIG. 2 partially represents an aircraft breathing device 200 according to a second embodiment. Some elements of the aircraft device 200 which do not differ from the aircraft device 100 to the aircraft device 200 are not represented since they are not essential for understanding. The elements of the regulator 101 and the elements of the regulator 1 which are identical or could be identical have the same reference number will not be described another time.

The aircraft breathing device 200 comprises a breathing mask 104 including a regulator 101 and an oronasal face piece 3.

The regulator 1 is of piloted valve regulator type whereas the regulator 101 is of direct valve regulator type. The regulator 101 mainly differs from the regulator 1 by the main valve 160 and the connection between the pilot valve 50 and the main valve 160.

The main valve 160 is preferably rigid and slidingly mounted on the casing 102 of the regulator 101. The main valve 160 is movable between a closed position and an open position. In the closed position, the main valve 160 is pressed against a seat 162 and isolates the upstream portion 12 of the breathable gas supply line from the downstream portion 13 of the breathable gas supply line. The seat 162 is preferably a seal in flexible material such as rubber or elastomeric material. In the open position of the main valve 160 the upstream portion 12 of the breathable gas supply line communicates with the downstream portion 13 of the breathable gas supply line through a passage between the main valve 160 and the seat 162. A spring 161 biases the main valve 160 towards the closed position.

As described above, the first surface 50*a* of the pilot valve 50 is subjected to the pressure in the respiratory chamber 9 and is movable between the rest position (illustrated) and the admission position according to difference of pressure between the pilot chamber 58 and the respiratory chamber 9.

In order to mechanically connect movement of the main valve 160 to movement of the pilot valve 50 and amplify the movement of the pilot valve 50, the regulator 101 further comprises a first lever 163 and a second lever 167, both rotatably mounted on the casing 102. In an alternative embodiment, at least one of the first lever 163 and the second lever 167 could be omitted, in case both of the first lever 163 and the second lever 167 would be omitted the stem of the main valve 160 would be directly in contact with a rigid portion of the pilot valve 50.

Therefore, when the pilot valve 50 is in the rest position, the main valve 160 is in the closed position and when the pilot valve 150 is in the admission position, the pilot valve 150 is in the open position.

More details concerning direct valve regulators could be found in FR 1 484 691 and FR 1 427 955 for example.

Of course, the invention is not limited to the embodiments provided for illustrative and not limitative purpose. For instance, the exhaled gas could be exhausted thanks to an exhaust valve distinct from the pilot valve 50.

The electrical control unit 40 and the cabin sensor 41 could be carried by the casing 2, 102 of the regulator 1, 101, a storage box intended to receive the breathing mask when not in use or disposed otherwise in the aircraft cabin.

Otherwise, in a variant the section of the passage 28 could be function of both the actuator 22 and an altimeter capsule. The actuator 22 and an altimeter capsule could face one another such as disclosed in U.S. Pat. No. 6,789,539, the actuator 22 and the altimeter capsule being directly fixed to the casing 2, 102 or preferably the altimeter capsule would be interposed between the actuator 22 and the casing 2, 102.

The invention claimed is:

1. An aircraft breathing device comprising a demand regulator and a source of breathable gas including high rate oxygen, the demand regulator comprising:

a respiratory chamber supplied with respiratory gas comprising breathable gas and dilution gas, a breathable gas supply line to be connected to the source of breathable gas and supplying the respiratory chamber with breathable gas, a dilution gas supply line to be connected to a source of dilution gas and supplying the respiratory chamber with dilution gas, a first adjusting device adjusting the pressure in the respiratory chamber, and a second adjusting device adjusting the rate of dilution gas in the respiratory gas supplied to the respiratory chamber, the second adjusting device comprising a dilution valve disposed in the dilution gas supply line and the dilution valve being movable between a retracted position and a protruded position, wherein (i) the first adjusting device is of non-electrical, pneumatic type, (ii) the second adjusting device comprises a sensor and an electrical control unit, the electrical control unit receiving a signal from the sensor and the electrical control unit adjusting the rate of dilution gas in the respiratory gas by controlling the dilution valve in function of said signal, and the sensor being selected from at least one of (a) an absolute pressure sensor sensing cabin or aircraft altitude, (b) a saturation sensor sensing an oxygen saturation in blood of a user of the device, (c) a flow meter sensing flow in the breathable gas supply line, the dilution gas supply line, or a respiratory gas supply line shared by a downstream portion of the breathable gas supply line and a downstream portion of the dilution gas supply line, (d) a gas sensor sensing a rate of oxygen flow in the respiratory gas supply line, or (e) a position sensor sensing position of the dilution valve, and (iii) the electrical control unit is configured to cause the dilution valve to move to any of the retracted position, the protruded position, or a plurality of positions intermediate the retracted and protruded positions, in response to receipt of the signal from the sensor.

2. A demand regulator for aircraft breathing device, the demand regulator comprising:

a respiratory chamber supplied with respiratory gas comprising breathable gas and dilution gas, a breathable gas supply line to be connected to a source of breathable gas and supplying the respiratory chamber with breathable gas, a dilution gas supply line to be connected to a source of dilution gas and supplying the respiratory chamber with dilution gas, a first adjusting device adjusting the pressure in the respiratory chamber, and a second adjusting device adjusting the rate of dilution gas in the respiratory gas supplied to the respiratory chamber, the second adjusting device comprising a dilution valve disposed in the dilution gas supply line and the dilution valve being movable between a retracted position and a protruded position, wherein the first adjusting device is of non-electrical type and the second adjusting device comprises a sensor and an electrical control unit, the electrical control unit receiving a signal from the sensor and the electrical control unit adjusting the rate of dilution gas in the respiratory gas by controlling the dilution valve in function of said signal, and a safety device for increasing the concentration of breathable gas in case of failure of the second adjusting device.

3. The demand regulator according to claim 2 wherein the safety device automatically places the dilution valve in the protruded position in case of failure of the second adjusting device.

4. The demand regulator according to claim 2 wherein the safety device automatically closes the dilution gas supply line in case of failure of the second adjusting device.

5. The demand regulator according to claim 3 wherein the safety device comprises a spring element biasing the dilution valve towards the protruding position.

6. The demand regulator according to claim 3 wherein the safety device comprises a battery and an electrical backup system powered by the battery.

7. The aircraft breathing device according to claim 1 wherein the demand regulator has a casing including a respiratory gas supply line shared by the downstream portion of the breathable gas supply line and the downstream portion of the dilution gas supply line.

8. The aircraft breathing device according to claim 1 wherein the whole dilution gas supply line has a section greater than 100 square millimeters when the dilution valve is in the retracted position.

9. The aircraft breathing device according to claim 8 wherein the breathable gas supply line is deprived of ejector ejecting breathable gas into the respiratory chamber.

10. The aircraft breathing device according to claim 1 wherein the pressure in the respiratory chamber is adjusted only by the first adjusting device.

11. The aircraft breathing device according to claim 1 wherein the second adjusting device comprises an electrical actuator driving the dilution valve.

12. A demand regulator for aircraft breathing device, the demand regulator comprising:

a respiratory chamber supplied with respiratory gas comprising breathable gas and dilution gas, a breathable gas supply line to be connected to a source of breathable gas and supplying the respiratory chamber with breathable gas, a dilution gas supply line to be connected to a source of dilution gas and supplying the respiratory chamber with dilution gas, a first adjusting device adjusting the pressure in the respiratory chamber, and a second adjusting device adjusting the rate of dilution gas in the respiratory gas supplied to the respiratory chamber, the second adjusting device comprising a dilution valve disposed in the dilution gas supply line and the dilution valve being movable between a retracted position and a protruded position, wherein the first adjusting device is of non-electrical type and the second adjusting device comprises a sensor and an electrical control unit, the electrical control unit receiving a signal from the sensor and the electrical control unit adjusting the rate of dilution gas in the respiratory gas by controlling the dilution valve in function of said signal, and wherein the first adjusting device comprises:

a main valve movable between a closed position in which the main valve closes the breathable gas supply line and an open position in which the main valve allows the breathable gas to flow, and a pilot valve having a first surface subjected to the pressure in the respiratory chamber and a second surface subjected to a set pressure, the pilot valve being movable between a rest position in which the pilot valve causes the main valve to be in the closed position and an admission position in which the pilot valve causes the main valve to be in the open position.

13. The demand regulator according to claim 12 wherein the pilot valve is movable in an exhaust position in which the respiratory chamber communicates with ambient air through an exhaust line.

14. The demand regulator according to claim 12 wherein the movement of the main valve from the closed position to the open position is pneumatically connected to the movement of the pilot valve from the rest position to the admission position.

15. The demand regulator according to claim 12 wherein the movement of the main valve from the closed position to the open position is mechanically connected to the movement of the pilot valve from the rest position to the admission position.

16. The aircraft breathing device according to claim 1 further comprising a warning device informing the user of a failure of the second adjusting device.

17. The aircraft breathing device according to claim 1 wherein in use the breathable gas supply line is continuously supplied with pressurized breathable gas from the source of breathable gas.

18. The aircraft breathing device according to claim 1 wherein the first adjusting device comprises a valve movable in an exhaust position in which the respiratory chamber communicates with ambient air.

19. An aircraft breathing device comprising a demand regulator and a source of breathable gas including high rate oxygen, the demand regulator comprising:

a respiratory chamber supplied with respiratory gas comprising breathable gas and dilution gas, a breathable gas supply line to be connected to the source of breathable gas and supplying the respiratory chamber with breathable gas, a dilution gas supply line to be connected to a source of dilution gas and supplying the respiratory chamber with dilution gas, a first adjusting device adjusting the pressure in the respiratory chamber, and a second adjusting device adjusting the rate of dilution gas in the respiratory gas supplied to the respiratory chamber, the second adjusting device comprising a dilution valve disposed in the dilution gas supply line and the dilution valve being movable between a retracted position and a protruded position, wherein (i) the first adjusting device is of non-electrical type, (ii) the demand regulator mixes the breathable gas and the dilution gas, and (iii) the second adjusting device comprises a sensor and an electrical control unit, the electrical control unit receiving a signal from the sensor and the electrical control unit adjusting the rate of dilution gas in the respiratory gas while simultaneously mixing the breathable gas and the dilution gas by controlling the dilution valve in function of said signal, and the sensor of the second adjusting device is chosen amongst at least one of (a) an absolute pressure sensor sensing cabin altitude or aircraft altitude, (b) a saturation sensor sensing an oxygen saturation in blood of a user of the device, (c) a flow meter sensing flow in the breathable gas supply line, the dilution gas supply line, or a respiratory gas supply line shared by a downstream portion of the breathable gas supply line and a downstream portion of the dilution gas supply line, (d) a gas sensor sensing a rate of oxygen flow in the respiratory gas supply line, or (e) a position sensor sensing position of the dilution valve.

20. The aircraft breathing device according to claim 1 wherein the source of breathable gas is pressurized and the source of dilution gas is not pressurized.

21. An aircraft breathing device comprising a demand regulator and a source of breathable gas including high rate oxygen, the demand regulator comprising:

a respiratory chamber supplied with respiratory gas comprising breathable gas and dilution gas, a breathable gas supply line to be connected to the source of breathable gas and supplying the respiratory chamber with breathable gas, a dilution gas supply line to be connected to a source of dilution gas and supplying the respiratory chamber with dilution gas, a first adjusting device adjusting the pressure in the respiratory chamber, and a second adjusting device adjusting the rate of dilution gas in the respiratory gas supplied to the respiratory chamber, the second adjusting device comprising a dilution valve disposed in the dilution gas supply line and the dilution valve being movable between a fully-open first position and a fully-closed second position, wherein (i) the first adjusting device is of non-electrical, pneumatic type, (ii) the second adjusting device comprises a sensor and an electrical control unit, the electrical control unit receiving a signal from the sensor and the electrical control unit adjusting the rate of dilution gas in the respiratory gas by controlling the dilution valve in function of said signal, and the sensor of the second adjusting device is chosen amongst at least one of (a) an absolute pressure sensor sensing cabin altitude or aircraft altitude, (b) a saturation sensor sensing an oxygen saturation in blood of a user of the device, (c) a flow meter sensing flow in the breathable gas supply line, the dilution gas supply line, or a respiratory gas supply line shared by a downstream portion of the breathable gas supply line and a downstream portion of the dilution gas supply line, (d) a gas sensor sensing a rate of oxygen flow in the respiratory gas supply line, or (e) a position sensor sensing position of the dilution valve, and (iii) the electrical control unit is configured to cause the dilution valve to move to any of the first position, the second position, or a plurality of positions intermediate the first and second positions, in response to receipt of the signal from the sensor.

* * * * *